United States Patent [19]

Cook

[11] 4,423,877

[45] Jan. 3, 1984

[54] GAME APPARATUS

[76] Inventor: Don W. Cook, 677 Dougherty Terrace Dr., Manchester, Mo. 63011

[21] Appl. No.: 420,109

[22] Filed: Sep. 20, 1982

[51] Int. Cl.[3] ..... A63B 67/12

[52] U.S. Cl. ..... 273/317; 273/353; 273/428

[58] Field of Search ..... 273/317, 353, 342, 428

[56] References Cited

U.S. PATENT DOCUMENTS

| | | | |
|---|---|---|---|
| 464,098 | 12/1891 | Harr | 273/353 X |
| 1,292,011 | 1/1919 | Monroe | 273/428 X |
| 1,325,436 | 12/1919 | Cressman | 273/342 |
| 1,680,356 | 8/1928 | Yaraus | 273/353 X |
| 2,261,448 | 11/1941 | Petersen | 273/353 X |
| 3,565,432 | 2/1971 | Reiner | 273/317 X |
| 3,784,200 | 1/1974 | Hotchkiss | 273/428 X |

*Primary Examiner*—William H. Grieb
*Attorney, Agent, or Firm*—Kalish & Gilster

[57] ABSTRACT

A game apparatus adapted to be played by a plurality of individuals incorporating an indicator for determining the order of turns of play of the players. The game apparatus comprehends a predetermined number of playing pieces of generally upwardly opening cup-shape form and of progressively greater height. Each playing piece bearing a number directly proportional to its height and corresponding to a number on the indicator. A tool provided each player for manipulating the playing piece having a number corresponding to that obtained by the player on the indicator for effecting inversion of the particular playing piece and, if successful, being accorded a point value corresponding to that upon the playing piece.

8 Claims, 6 Drawing Figures

GAME APPARATUS

BACKGROUND AND SUMMARY OF THE INVENTION

This invention relates in general to amusement devices and, more particularly, to an apparatus for a game which may be played upon any convenient surface such as a table or the like.

The present invention constitutes a game which demands the exercise of a level of manual dexterity on the part of the players; the aim being to cause a playing piece to be propelled into an altered position by means of manipulating a moment-arm constituting element. The apparatus is of such proportions as to permit the game to be played upon a table so that the players may be comfortably disposed thereabout and with the playing involving an excitement-promoting competition.

Heretofore, efforts have been made to develop games involving the movement of a playing piece so that the scoring will be dependent upon the change of position of the playing piece, that is, in games other than those wherein playing pieces are intentionally manually moved between predetermined stations. Thus, reference may be made to the well-known game of Tiddildy Winks wherein the playing pieces are propelled by a manually applied force to effect substantial travel but without necessarily any change in the attitude of the playing pieces per se. Other games have utilized a player's foot or a player's breath for effecting motivation of the playing pieces but without concern as to a change in attitude of the playing pieces with respect to the support surface.

Therefore, it is an object of the present invention to provide a game apparatus which incorporates uniquely constructed playing piece subjectable to manipulation by a tool for altering its attitude to the playing surface upon the completion of the force application.

It is another object of the present invention to provide a game apparatus which may be played by a plurality of players and which is productive of keen competition despite any variances in the particular dexterity of the players.

It is a further object of the present invention to provide a game apparatus of the type stated which comprises a limited number of game components of sturdy construction being hence resistant to damage so that durability is assured.

It is another object of the present invention to provide a game apparatus which is economical in production; which in the playing is not restricted to any predetermined number of players; and which involves the exercise of judgment by the players so that the game besides being pleasurable is also educative.

DESCRIPTION OF THE PREFERRED EMBODIMENT

Figure 1:
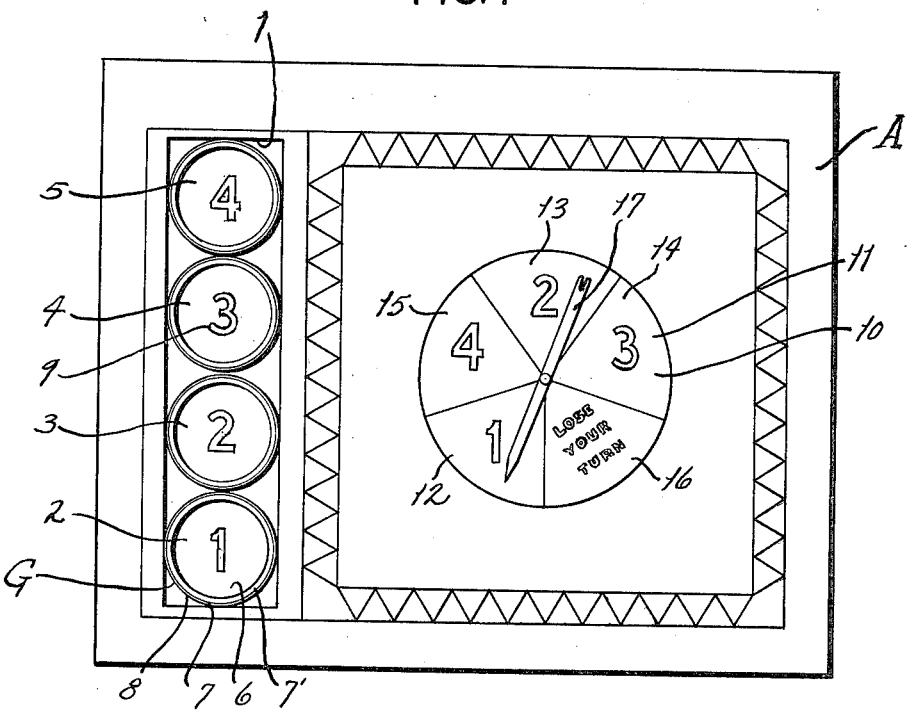
FIG. 1 is a top plan view of the game board and game pieces constructed in accordance with and embodying the present invention illustrating the same in inoperative position.
Figure 2:
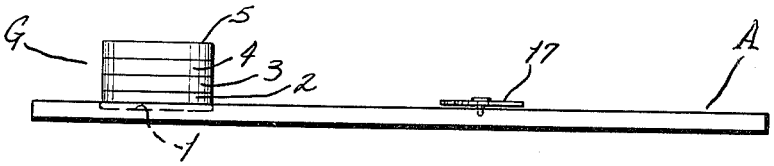
FIG. 2 is a front elevational view of the game board as shown in FIG. 1.

Referring now by reference characters to the drawings which illustrate the preferred embodiment of the invention, A generally indicates a game board of, preferably, rectangular form and fabricated of any suitable rigid material, such as paperboard, cardboard, plastic or the like and which board may, if desired, constitute the top surface of a box construction (not shown). Provided in one lateral portion of board A is an upwardly opening elongated recess 1 forming a receptacle for the game pieces G herein shown as being four in number, as at 2, 3, 4 and 5. For purposes of illustration, the number of game pieces is set forth as stated but it is to be recognized that within the scope of the operation of the game, as will become more evident hereinbelow, a greater number of game pieces may be included. Each game piece is of basic cup-like construction having a base wall 6; cylindrical side wall 7 with there being a base rim 8 projecting beyond the associated side wall 7. However, the side walls 7 of the game pieces are of graduated height so that game piece 2 is of lesser height than the side wall of game piece 3 which, in turn, is not as high as that of game piece 4; and, hence, with game piece 5 having the highest side wall. It will, of course, be seen that the incremental increase in height between consecutive game pieces G is preselected so that such is not critical. However, the progressive increase constitutes the crucial factor as will be seen hereinbelow. Formed suitably in the upper face of the base 6 of each game piece 2, 3, 4 and 5 is a numeral 9 and with the same being of increasingly greater value in direct proportion to the relative height differentials. Thus, game piece 2 with the lowest side wall 7 will have its numeral 9 of a lower value, such as "1" than the corresponding numeral in game piece 3 which may be "2". The numeral 9 presented in the base of each game piece G represents the number of points which a player will achieve should he successfully alter the disposition of the game pieces G during game operation. The game pieces G may be fabricated of any suitable wear-resistant material, such as cardboard, paperboard, plastic, sheet metal, or the like or could have a base 6 formed of thin metal with a fiber side wall 7.

Provided on the upper face of board A is a dial 10 which is divided into the number of segments 11 which correspond to the number of game pieces G plus one so that in the drawing there are shown five segments; four of which bear numerals corresponding to numerals 9 of the playing pieces G as in segments 12, 13, 14 and 15 which directly relate to playing pieces 2, 3, 4 and 5, respectively. The fifth segment 16 which carries the notation "Lose Your Turn" is, thus, a penalty zone. Pivotally mounted upon board A centrally of dial 10 is a spinner 17.

Figure 5:
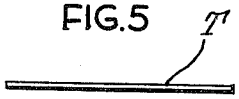
FIG. 5 is a side elevational view of the manipulating tool.
Figure 6:
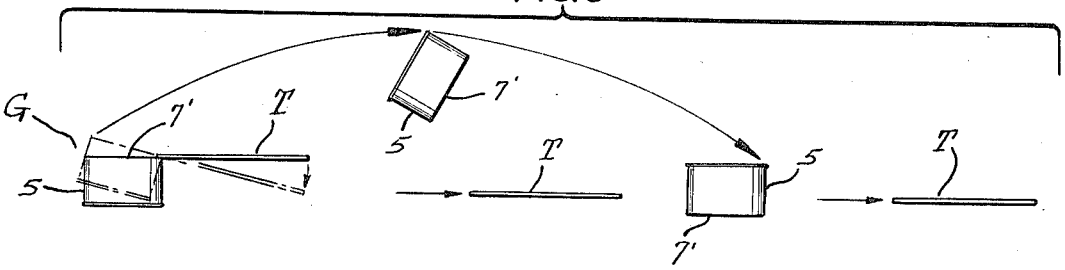
FIG. 6 is a series of side elevational views illustrating in sequence the operation of the tool to alter the disposition of a playing piece.

Turning now to FIGS. 5 and 6, T indicates an elongated manipulating tool which is fabricated of any suitable rigid material, such as wood or plastic, and which, as may be seen in FIG. 5, is relatively thin so that the same may be easily grasped by a player.

The use of tool T in conjunction with a playing piece G is illustrated in FIG. 6. The object is to handle tool T with reference to a game piece so as to cause same to move through an arc of 180°, that is, into inverted position wherein it will rest upon the normally upper edge 7′ of the associated side wall 7. Thus, one end portion of tool T is flat-wise disposed upon the upper edge 7′ of the selected game piece G and a force having a downward component is applied upon the engaged edge with there also being an outwardly or withdrawing component to such force so as to cause the game piece G to pivot upon its lower edge and, thence, rock into inverted position. Thus, tool T provides a moment arm and, as stated, is so manipulated as to provide both downward as well as outward components of movement. The degree of dexterity in utilizing tool T increases with the height of playing pieces G so that the skill in inverting playing piece 5 is higher than that required for inverting playing piece 2, which has the lowest side wall. A player is only entitled to one manipulation to achieve the desired result and, thus, may not continue to apply tool T to the particular game piece G during any effort to effect inversion. The particular dexterity required for bringing about the intended inversion is of a surprising level since an application of excessive force may very well cause the particular game piece G to actually move through two successive arcs of 180° and, thus, be restored to initial or starting position which is of no value to the player. Other times, the improper application of the requisite force may cause the game piece G to stablize after travel through an arc of 90° and, thus, be disposed to roll about its side wall. Therefore, contrary to any expectation, the use of tool T upon game pieces G necessitates close attention and carefully controlled physical exertion.

Figure 3:
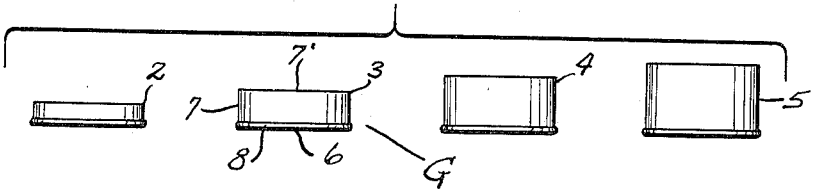
FIG. 3 illustrates a side elevational view of each of the game pieces.
Figure 4:
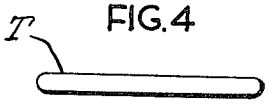
FIG. 4 is a top plan view of the manipulating tool.

In view of the foregoing, the actual playing of the game of the present invention should become readily apparent. Each of the players effects rotation of spinner 17 and the one obtaining the highest number will be the one to have the first play with the others succeeding either in a clockwise or counterclockwise manner, as desired. The aforesaid first player will then cause spinning of spinner 17 to determine which game piece he will have the opportunity to "flip" or rock into inverted position. If the spinner comes to rest on number "4" within segment 15 then the said player takes corresponding game piece 5 and by applying tool T to the upper edge 7′ thereof with the said game piece 5 in the position shown in FIG. 3 endeavors to cause same to rock into inverted position, all as above described. If he is successful in such maneuver, he is then entitled to four points as his score. Then, each player takes his turn successively in like manner and tries to "flip" the predetermined game piece G. If a player is unsuccessful in effecting the inversion, he obtains no points for his effort and the first player to garner a predetermined number of points, such as 20, will be claimed the winner. It is, of course, obvious that if in operating spinner 17 the pointer thereof comes to rest in segment 16, then, manifestly, that player must forego his turn.

Thus, the present invention constitutes a game, the playing of which can bring about heightened enjoyment and pleasure as well as conducing to enhance the manual dexterity of the players.

What is claimed is:

1. A game apparatus for play by a preselected number of players comprising a segmentally divided indicator, manually operable means associated with said indicator for chance segment selection, a plurality of playing pieces, there being an indicator segment corresponding to at least each playing piece, each of said playing pieces being of generally upwardly opening cup-shape character and of varying height, there being an elongated stick-like tool provided each player for manipulating a predetermined playing piece in an endeavor to dispose same in inverted position for effecting point scoring.

2. A game apparatus as defined in claim 1 and further characterized by each playing piece having provided thereon a numeral representing the point value for inverting such playing piece, the corresponding indicator segment also bearing the same numeral.

3. A game apparatus as defined in claim 2 wherein each playing piece is provided with a cylindrical side wall and with the height of said side wall being directly proportional to the point value for inverting such playing piece.

4. A game apparatus as defined in claim 3 wherein the indicator constitutes a disk and the manually operable means comprises a spinner arm rotatably mounted centrally upon said disk.

5. A game apparatus as defined in claim 4 wherein the indicator disk comprehends at least one segment which does not correspond to a playing piece for providing a penalty against a player turn if selected through operation of said spinner.

6. A game apparatus as defined in claim 3 wherein said cylindrical side wall of each playing piece is provided with a top edge and the manipulation of the tool requires positioning of the tool upon the top edge of the predetermined playing piece for applying a force having downwardly and outwardly directed force vectors.

7. A game apparatus as defined in claim 2 wherein each playing piece comprises a base wall and an upstanding cylindrical side wall, the point value numeral of each playing piece being provided on the upwardly directed face of the base wall, said indicator having at least a segment correspondihg to each playing piece and with each such corresponding segment having displayed thereon the same numeral as appearing upon the related playing piece so that the chance selection of a segment carrying a numeral will indicate the playing piece for tool manipulation by the particular player.

8. A game apparatus as defined in claim 1 and further characterized by a flat board-forming member for disposition upon a suitable support surface and having an upper wall, said indicator being provided on said upper wall and there being an upwardly opening recess provided spacedly from said indicator and within said upper wall, said recess being dimensioned for accepting said playing pieces in juxtaposition when in inoperative position and with the said playing pieces opening upwardly when in said recess.

* * * * *